US009055642B2

(12) United States Patent
Maa et al.

(10) Patent No.: US 9,055,642 B2
(45) Date of Patent: Jun. 9, 2015

(54) MULTI-PURPOSE RECHARGEABLE LED LIGHTING DEVICE

(71) Applicant: LIGHTEL TECHNOLOGIES INC., Renton, WA (US)

(72) Inventors: Chia-Yiu Maa, Bellevue, WA (US); Ching-Feng Lin, Taipei (TW); Pai-Sheng Shen, Bellevue, WA (US)

(73) Assignee: Lightel Technologies, Inc., Renton, WA (US)

( * ) Notice: Subject to any disclaimer, the term of this patent is extended or adjusted under 35 U.S.C. 154(b) by 421 days.

(21) Appl. No.: 13/645,446

(22) Filed: Oct. 4, 2012

(65) Prior Publication Data

US 2014/0097757 A1 Apr. 10, 2014

(51) Int. Cl.
*H05B 37/00* (2006.01)
*H05B 33/08* (2006.01)

(52) U.S. Cl.
CPC ..... *H05B 33/0842* (2013.01); *H05B 33/0803* (2013.01); *H05B 33/0806* (2013.01)

(58) Field of Classification Search
USPC ..... 315/88, 160, 161, 173, 193, 297, 307, 315/312, 313, 362
See application file for complete search history.

(56) References Cited

U.S. PATENT DOCUMENTS

| | | | | |
|---|---|---|---|---|
| 2009/0154148 | A1* | 6/2009 | Meyer et al. | 362/157 |
| 2011/0305056 | A1* | 12/2011 | Chien | 363/178 |
| 2013/0241418 | A1* | 9/2013 | Kercso et al. | 315/152 |

* cited by examiner

*Primary Examiner* — Douglas W Owens
*Assistant Examiner* — Jianzi Chen
(74) *Attorney, Agent, or Firm* — Pai Patent & Trademark Law Firm; Chao-Chang David Pai

(57) ABSTRACT

An LED lighting device includes at least one LED light source emitting light, at least one rechargeable battery for supplying power when external power is not available, at least one electrical connector for connecting the rechargeable battery to external power source for recharging, and at least one control mechanism for switching the operation mode of the device. By setting the operation mode via the control mechanism, the LED light device can be used for more than one intended purposes such as regular lighting, emergency lighting, and flashlight.

19 Claims, 7 Drawing Sheets

MULTI-PURPOSE RECHARGEABLE LED LIGHTING DEVICE

BACKGROUND OF THE INVENTION

1. Field of the Invention

This invention relates to LED lighting devices and more particularly to a multi-purpose rechargeable LED lighting device.

2. Description of the Related Art

LED (light-emitting diode) has been used as the light source for regular lighting purpose where LED luminaire is on when there is external power. When the external power is turned off, the LED luminaire is shut off.

LED luminaire has also been used as an emergency lighting device where the luminaire is off when there is external power source. When the external power source is turned off, the LED luminaire is turned on automatically and powered by the internal battery, thus providing illumination during emergency without external power.

LED luminaire has further been used as a flashlight where the battery provides the sole power source for the flashlight.

The present invention combines at least one LED lighting component, at least one rechargeable battery, and a control mechanism to create a rechargeable, multi-purpose LED luminaire that is applicable to all of the different intended uses.

SUMMARY OF THE INVENTION

The present invention comprises at least one LED light source, at least one rechargeable battery for supplying power when external power source is not available, a means of connecting the rechargeable battery to external power source, and at least one control mechanism for switching the operation mode of the device. The present invention is characterized by that through the setting of the operation mode via the control mechanism, the LED light device can be used for more than one intended purposes.

In one operation mode, the present invention operates like a regular LED light device. In this case, when the external power source is on, the LED light source of the device is on. When the external power source is turned off, the LED light source of the device is shut off.

In another operation mode, the present invention operates like an emergency light. In this case, when the external power source is on, the LED light source is shut off and the rechargeable battery is charged by the external power. When the external power is turned off, due to perhaps power outage, the LED light source is turned on automatically and it operates by drawing power from the rechargeable battery, thus providing emergency lighting.

In another operation mode, the present invention operates both as regular light and an emergency light at the same time. In this case, when the external power source is on, the LED light source is also on and the rechargeable battery is charged by the external power. When the external power is turned off, due to perhaps power outage, the LED light source stays on by drawing power from the rechargeable battery, thus providing emergency lighting.

In yet another operation mode, the present invention is detached from the external power source. The device is portable and it operates like a flashlight, drawing power from the rechargeable battery. After use, the device is re-attached to an external power source for recharging.

The means of connecting the device to external power source is not restricted to any particular connection mechanism or standards. The exact power source connection depends on the operation and housing environment of the device. In one implementation, the means of connecting the device to external power source is a wall-mounted recharging base, for both recharging the battery and holding the device. In another implementation, the means of connecting the device to external power source is an E-base connector. In addition, any standard base light bulb sockets or power connection type is permissible.

In another aspect of the present invention, a lighting adjustment component is included with the device for adjusting the lighting angle and the lighting focus of the device. This is particularly useful when the device is detached from the external power source and carried around.

In another aspect of the present invention, a lumen output control mechanism is included with the device for controlling the lumen output of the device according to preconfigured stages. It is thus conceivable to set the lumen output of the device to full capacity during regular working or functioning hours, and to change the lumen output of the device to a fractional capacity during off-hours or at night, thus conserving energy. A more elaborated implementation of the lumen output control mechanism is to use a built-in dimmer circuitry, where the lumen output adjustment is made gradually rather than in a step-wise fashion used in a simple implementation.

In another aspect of the present invention, a timer function can be included with the lumen output control mechanism such that the lumen output of the device varies according to a preset time schedule automatically.

In another aspect of the present invention, an ambient light sensor is included with the device for triggering the adjustment of the lumen output of the device according to the ambient light. With a simple light sensor, the LED light source is automatically turned on when the ambient light is below a certain level. In a more elaborated light sensor, the LED light source is turned on but its lumen output is inversely proportional to the ambient light drop, i.e., the darker the ambient environment, the more lumen output will be emitted from the LED light source.

In another aspect of the present invention, a motion sensor is included with the device such that the motion sensor turns on the device upon detecting a motion and shuts off the device after a preset time period.

In another aspect of the present invention, a sound sensor is included with the device such that the sound sensor turns on the device upon detecting sound above a certain level and shuts off the device according to a preset on-time setting.

The present invention differs from the prior art in that it is intended for multi-purpose applications by combining LED light sources, rechargeable battery, and suitable control mechanism and additional components.

The claims and advantages will be more readily appreciated as the same becomes better understood by reference to the following detailed description and the accompanying drawings showing exemplary embodiments, in which like reference symbols designate like parts. For clarity, various parts of the embodiments in the drawings are not drawn to scale.

DETAILED DESCRIPTION OF THE INVENTION

Various implementations of the present invention and related inventive concepts are described below. It should be acknowledged, however, that the present invention is not limited to any particular manner of implementation, and that the various embodiments discussed explicitly herein are primarily for purposes of illustration. For example, the various concepts discussed herein may be suitably implemented in a variety of luminaires having different form factors and light output.

Figure 1B:
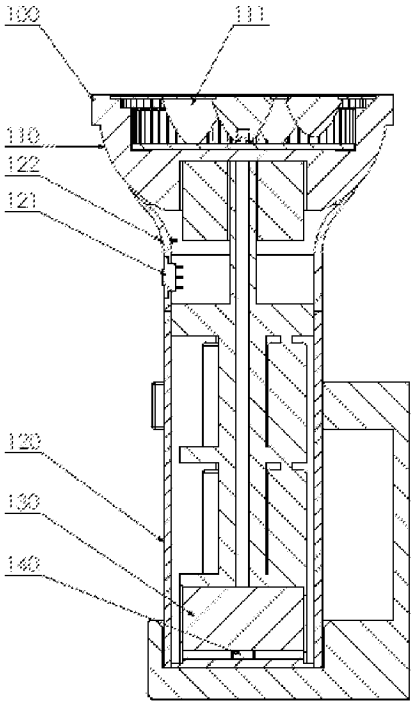
FIG. 1B shows a sectional view of the embodiment in FIG. 1A.
Figure 1A:
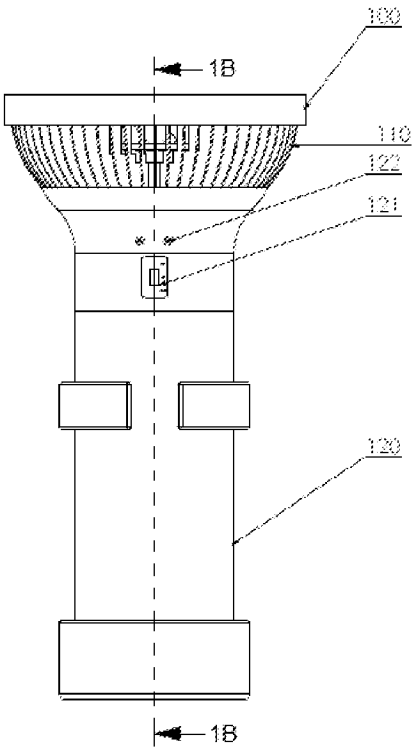
FIG. 1A schematically depicts an embodiment of the present invention wherein the LED light sources are on one-side of the device, a rechargeable battery is on the other side of the device, an electrical connector is attached directly to the battery for recharging, and a tri-mode control switch.

FIG. 1 illustrates one non-limiting example of an LED lighting device according to one embodiment of the present invention. The LED lighting device 100 includes an LED lighting module 110 with multiple LED light sources 111, a housing 120, a rechargeable battery 130, a connector 140 for connecting the LED lighting device to external power source, and a tri-mode control switch 121 for switching the operation mode of the LED lighting device.

A recharging indictor 122 is also included with this embodiment of the invention for displaying whether the battery is charging, fully charged, or dead.

In FIG. 1, the LED lighting module 110 can be enhanced to include a lighting adjustment component for adjusting the lighting angle and the lighting focus of the LED lighting device.

A second control mechanism such as dimmer circuitry and switch can be added to provide a dimming function.

Alternatively, a timer can be added to control the lighting according to the time of the day.

Alternatively, an ambient light sensor can be added for triggering the adjustment the lumen output of the device via the control mechanism according to the ambient light.

Alternatively, a motion sensor can be added such that during normal operation the motion sensor turns on the device upon detecting a motion and shuts off the device after a preset time period.

Alternatively, a sound sensor can be added such that during normal operation the sound sensor turns on the device when detecting a sound above a preset level, and shuts off the device according to a preset on-time setting Alternatively, a control mechanism is added to the lighting device so the lighting pattern, color, and lumen output of the device can be controlled by a user or by a preconfigured program. The controlling of the lighting pattern determines which of the at least one LED light source will be on.

Additionally, the lighting device is equipped with wireless connection mechanism and the color and illumination control so that the lighting pattern, color, and lumen output of the device can be remotely controlled via the wireless connection.

Figure 6:
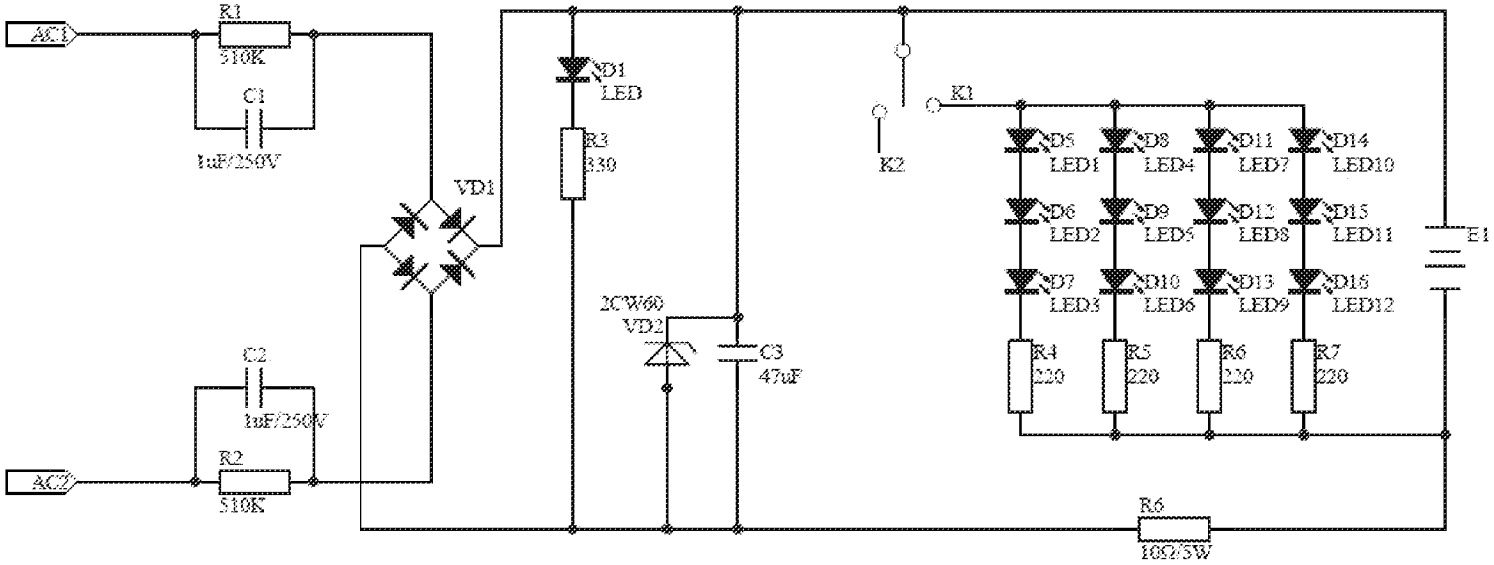
FIG. 6 schematically depicts the circuitry for the tri-mode control switch.

FIG. 6 is one embodiment of the control circuit for supporting the tri-mode operation. On Mode 1, when external power is on, namely, the external power source is active and connected to the device, K1 is connected such that LED is on and the battery is charged. When external power is off, namely when the external power source is inactive or disconnected from the device, K2 is connected such that LED is off and the battery has no effect on the LED. Therefore the device is operating as a regular lighting device.

On Mode 2, when external power is on, K2 is connected such that LED is off and the battery is charged. When external power is off, K1 is connected such that LED is on by drawing power from the battery. In this mode, the lighting device functions strictly as an emergency lighting source.

On Mode 3, when external power is on, K1 is connected such that LED is on and the battery is charged. When external power is off, K1 is still connected such that LED is on by drawing power from the battery. In this mode, the lighting device functions both as a regular device and an emergency lighting source.

The device can be used as a flash light by firstly detaching the device from the external power source and then switch to Mode 3. The flash light is turned off by switching from Mode 3 to Mode 1, as the LED is off on Mode 1 when there is no external power source.

Figure 2:
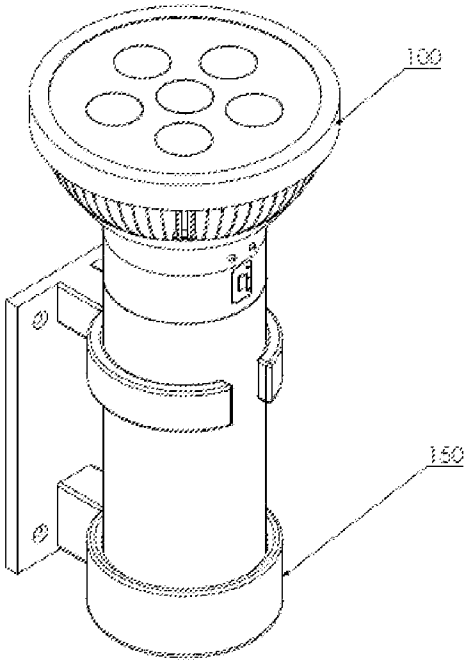
FIG. 2 schematically depicts an embodiment of the present invention wherein the LED lighting device is used in conjunction with a wall-mounted base.

FIG. 2 illustrates an embodiment of the present invention 100 with the use of a wall-mounted recharging base 150. The recharging base has electrical wiring connecting to the connector 140 of the rechargeable battery and the external power source. Additionally, the recharging base holds the LED lighting device during recharging.

Figure 3B:
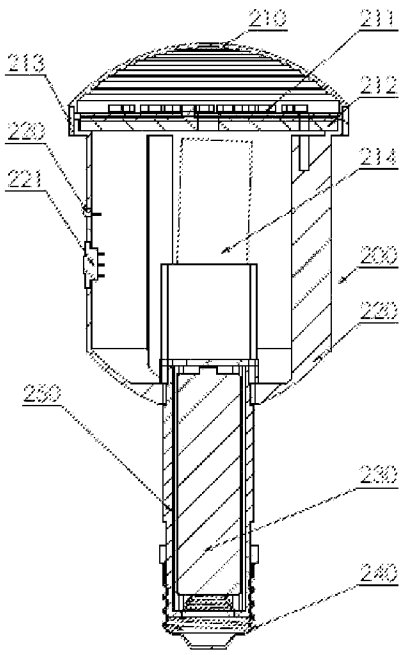
FIG. 3B shows a sectional view of the embodiment in FIG. 3A.
Figure 3A:
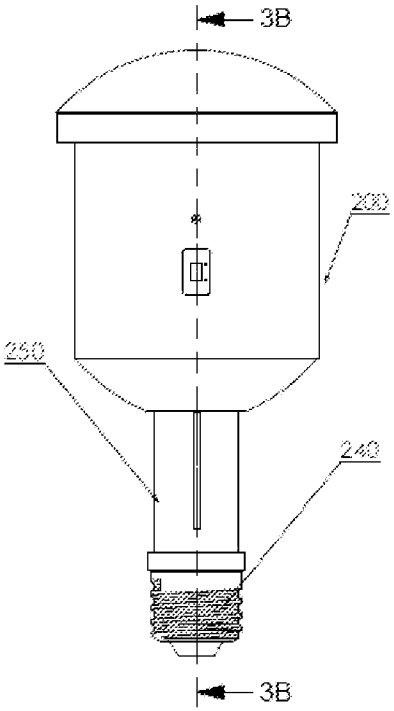
FIG. 3A schematically depicts an embodiment of the present invention wherein the LED lighting device has an E-base connector attached to a retractable hand-holder.

FIG. 3 illustrates another embodiment of the present invention. The LED lighting device 200 includes an LED lighting module 210, a housing 220, a rechargeable battery 230, an E-base connector 240, a tri-mode control switch 221 for switching the operation mode of the LED lighting device, and a hand-holder 250.

The LED lighting module 210 comprises multiple LED light sources 211, a heat sink component 212 for heat dissipation, a covering lens 213 which is either transparent or translucent, and a driver 214 for converting the battery power to drive the LED light sources 211. An E-Base connector 240 is used with embodiment 200 so that the LED lighting device can be screwed into an E-based electrical socket.

Figure 4B:
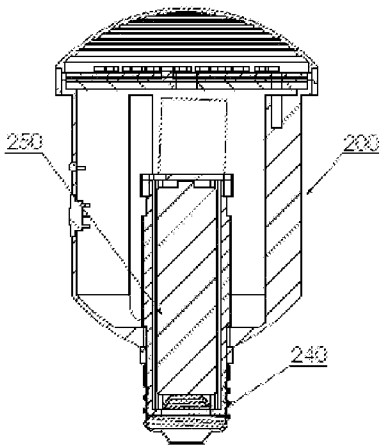
FIG. 4B shows a sectional view of the embodiment in FIG. 4A.
Figure 4A:
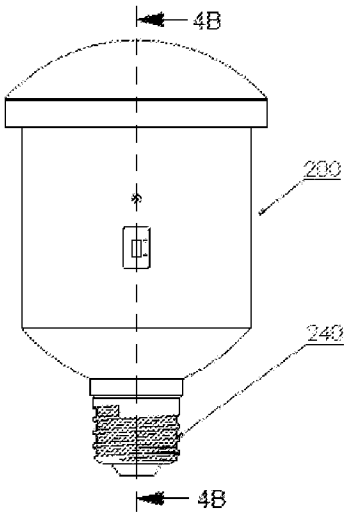
FIG. 4A schematically depicts an embodiment of the present invention wherein the retractable hand-holder of the LED lighting device with an E-base connector is retracted.

Additionally, the embodiment 200 uses the hand-holder 250 that is retractable. When detached from the E-base electrical source, the hand-holder 250 is adjusted to the extended mode as shown in FIG. 3. When the LED light device is screwed into an E-based electrical socket, the hand-holder 250 can be adjusted to the retracted mode as shown in FIG. 4.

The operation of embodiment 200 is similar to embodiment 100, and it can operate for regular lighting, emergency lighting, and as a flashlight depending on the setting of the operation mode through the control switch 221.

Figure 5A:
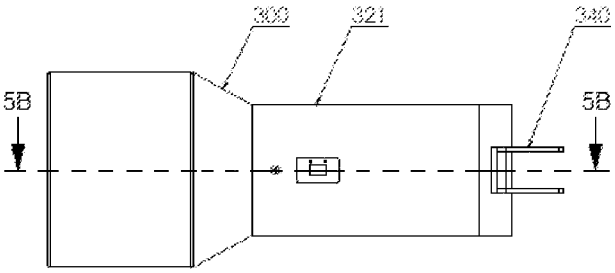
FIG. 5A schematically depicts an embodiment of the present invention wherein the LED lighting device has a foldable electrical connector that can be plugged directly into a standard electrical socket.
Figure 5B:
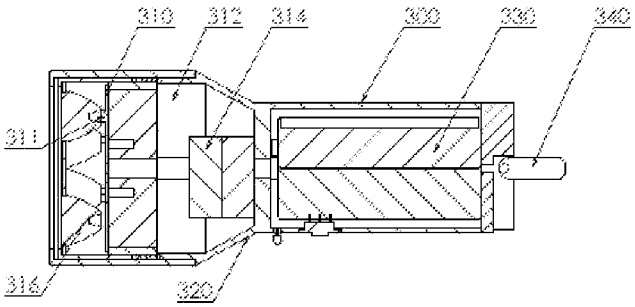
FIG. 5B shows a sectional view of the embodiment shown in FIG. 5A.

FIG. 5 illustrates another embodiment of the present invention. The LED lighting device 300 includes an LED lighting module 310, a housing 320, a rechargeable battery 330, a foldable electrical connector 340, and a tri-mode control switch 321 for switching the operation mode of the LED lighting device.

The LED lighting module 310 comprises multiple LED light sources 311, multiple reflector cups 316, a heat sink component 312 for heat dissipation, and a driver 314 for converting the battery power to drive the LED light sources 311. The multiple reflectors cups 316 are divided into different sets and each set has a unique lighting angle and focus. Additionally, the LED lighting module 310 is rotatable for the purpose that when it rotates from one position to another position, the set of reflector cups 316 used by the light sources 311 will also be switched from one set to another set, thus yielding a different lighting angle and focus. When two sets of reflector cups 316 are used, one set is used for close-up lighting, and the other set to distant lighting.

A foldable electrical connector 340 is used with embodiment 300 so that the LED lighting device can be plugged directly into an electrical socket. When detached from the electrical socket, the foldable electrical connector 340 can be folded.

The operation of embodiment 300 is similar to embodiment 100, and it can operate for regular lighting, emergency lighting, and as a flashlight depending on the setting of the operation mode through the control switch 321.

Figure 7A:
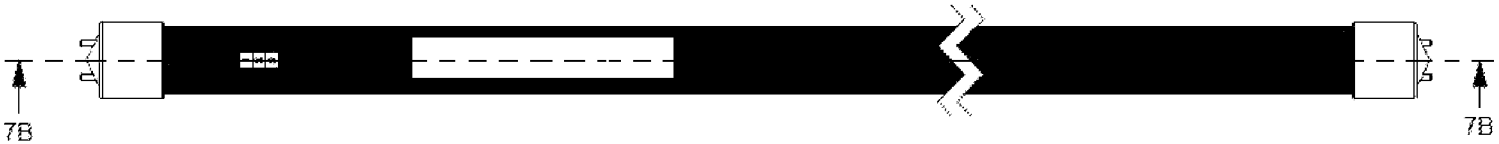
FIG. 7A schematically depicts an embodiment of the present invention wherein the LED light sources are arranged in a linear array as part of one or more linear LED lighting tubes.
Figure 7B:
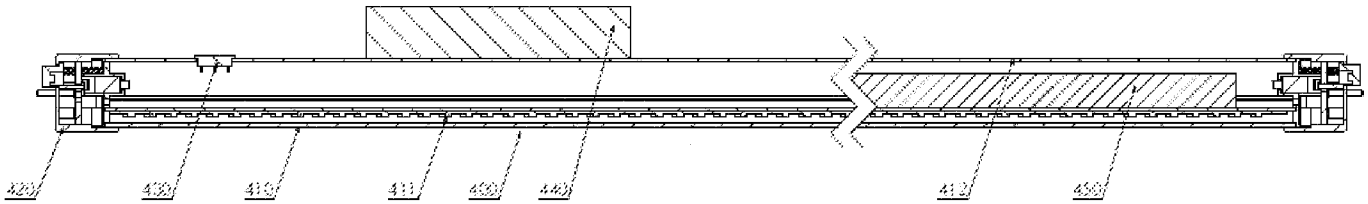
FIG. 7B shows a sectional view of the embodiment shown in FIG. 7A.

FIG. 7 illustrates another embodiment of the present invention. The LED lighting tube device 400 includes an LED lighting module 411, a covering lens 410, a heat sink component 412, a pair of end caps 420, an internal power driver 450, a rechargeable battery 440, and a 3-mode switch 430 for switching the operation mode of the LED lighting device.

The operation of embodiment 400 is similar to embodiment 100, and it can operate for regular lighting, emergency lighting, and as a flashlight depending on the setting of the operation mode through the control switch 430. In another implementation, an external power driver can be used to replace the internal power driver 450.

Alternatively, the battery 440 can be embedded inside the lighting tube device so that when the device is detached from the lighting fixture, it can operate as a lighting bar for lighting purpose.

Alternatively, a control mechanism is added to the lighting bar so the lighting pattern, color, and lumen output of the light bar can be controlled by a user or by a preconfigured program. Additionally, a wireless connection mechanism is added to such light bar to remotely control the lighting pattern, color, and lumen output of the light bar.

While the invention has been described and illustrated in its preferred embodiments, it should be understood that departure therefrom may be made within the scope of the invention, which is not limited to the specific details disclosed herein.

What is claimed is:

1. An LED lighting device comprising at least one LED light source, at least one rechargeable battery for supplying power to the at least one LED light source, at least one electrical connector for connecting the at least one rechargeable battery to external power source for recharging, and at least one control mechanism for switching the device to any of a plurality of operation modes, wherein the at least one LED light source is the only light source in the LED lighting device, and the plurality of operation modes includes (a) a regular lighting device mode wherein the at least one rechargeable battery supplies power to the at least one LED light source when the external power source is on, and all of the at least one LED light source is off when the external power source is off; (b) an emergency lighting device mode wherein the at least one rechargeable battery supplies power to the at least one LED light source when the external power source is off, and all of the at least one LED light source is shut off when the external power source is on; and (c) a portable flashlight mode wherein the LED lighting device as a whole is portable and the at least one rechargeable battery supplies power to the at least one LED light source without connecting to any external power source.

2. The LED lighting device of claim 1, wherein the external power source is derived from another lighting fixture.

3. The LED lighting device of claim 1, wherein an internal driver circuitry is used for converting the power of the at least one rechargeable battery to drive the at least one LED light source.

4. The LED lighting device of claim 2, wherein an internal driver circuitry is used for converting the power of the at least one rechargeable battery to drive the at least one LED light source.

5. The LED lighting device of claim 1, further comprising a lighting adjustment mechanism for adjusting the angle and the focus of light emitting from the at least one LED light source.

6. The LED lighting device of claim 5, wherein the lighting adjustment mechanism comprises a plurality of sets of reflector cups.

7. The LED lighting device of claim 1, further comprising a control mechanism for controlling the lighting pattern, the color, and the lumen output of the device.

8. The LED lighting device of claim 7, further comprising a wireless connection mechanism for remotely controlling the lighting pattern, the color, and the lumen output of the device.

9. The LED lighting device of claim 7, further comprising a timer for setting the lumen output of the device according to a preset time schedule.

10. The LED lighting device of claim 7, further comprising an ambient light sensor for triggering the adjustment of the lumen output of the device according to the ambient light level.

11. The LED lighting device of claim 1, further comprising a motion sensor, wherein the motion sensor turns on the device upon detecting a motion and shuts off the device after a preset time period.

12. The LED lighting device of claim 1, further comprising a sound sensor, wherein the sound sensor turns on the device upon detecting a sound above a preset level, and shuts off the device after a preset time period.

13. The LED lighting device of claim 1, wherein the at least one electrical connector for connecting the at least one rechargeable battery to external power source includes a wall-mounted base.

14. The LED lighting device of claim 1, wherein the at least one electrical connector for connecting the at least one rechargeable battery to external power source includes an E-base connector.

15. The LED lighting device of claim 14, wherein the E-base connector is attached to a retractable hand-holder.

16. The LED lighting device of claim 1, wherein the at least one LED light source is arranged in a linear array.

17. The LED lighting device of claim 16, further comprising a control mechanism for controlling the lighting pattern, the color, and the lumen output of the device.

18. The LED lighting device of claim 17, further comprising a wireless connection mechanism for remotely controlling the lighting pattern, the color, and the lumen output of the device.

19. The LED lighting device of claim 1, wherein the at least one electrical connector for connecting the at least one rechargeable battery to external power source includes a foldable electrical plug for electrical outlet.

* * * * *